United States Patent [19]

Smith

[11] 4,421,154

[45] Dec. 20, 1983

[54] FAIL SAFE AIR WIPE

[75] Inventor: Michael C. Smith, LaGrange, Ga.

[73] Assignee: Southwire Company, Carrollton, Ga.

[21] Appl. No.: 330,115

[22] Filed: Dec. 14, 1981

[51] Int. Cl.[3] ..... B22D 11/06

[52] U.S. Cl. ..... 164/158; 164/433; 15/306 A; 15/316 R; 15/256.51

[58] Field of Search ..... 164/121, 158, 481, 482, 164/431–434; 15/306 A, 316 R, 256.51

[56] References Cited

U.S. PATENT DOCUMENTS 3,103,030 9/1963 Sands ..... 15/306 A 4,281,431 8/1981 Nierlich et al. ..... 15/306 A X

*Primary Examiner*—Kuang Y. Lin

*Attorney, Agent, or Firm*—Herbert M. Hanegan; Robert S. Linne; Michael C. Smith

[57] ABSTRACT

A fail safe air wipe for use with a casting band cleaning system wherein cleanser and rinsing agent used to clean the casting band of a continuous casting machine is removed from the band by mechanical wiping means when pneumatic supply to pneumatic wiping means falters to prevent explosion which may result from contacting the molten material being cast with the cleanser or rinsing agent.

13 Claims, 6 Drawing Figures

FAIL SAFE AIR WIPE

TECHNICAL FIELD

The present invention relates generally to a system for cleaning the band of a conventional wheel and band type continuous casting machine or a conventional multiple band type continuous casting machine and specifically to a fail safe air wipe for ensuring removal of cleanser and rinsing agent from the band or bands prior to introducing the molten material being cast to the band to prevent explosion.

BACKGROUND ART

It is well known in the casting arts that introduction of foreign matter into a melt can result in unsafe conditions. Where for example, water comes into contact with molten metal a steam expansion explosion or chemical reaction type explosion may result.

In a conventional wheel and band type continuous casting machine such as that disclosed in U.S. Pat. No. 3,279,000, a continuously moving band cooperates with the peripheral casting groove of a continuously rotating casting wheel to form a mold for the continuous casting of metal bar. During operation of such a casting machine it often happens that foreign material becomes inadvertently attached to the mold side of the band. Additionally, many components of band type casting systems purposely apply materials to the casting band. Examples are disclosed in: U.S. Pat. No. 3,322,184 where soot is applied to the mold surfaces; U.S. Pat. No. 3,575,231 where a heat conducting medium is injected into the solidification gap between the cast product and the mold; U.S. Pat. No. 3,976,119 which applies a fluid coating to the mold surface; and U.S. Pat. No. 4,069,860 which provides ablative material on the surface of the casting band. Where either unwanted materials or unwanted excesses of required materials become attached to the casting band, detriment to the cast product can result. Such results may include cast product surface imperfections as well as inner solidification defects such as inverse segregation.

To avoid these problems, it has been suggested that such materials be continuously cleaned from the surface of the band by a band cleaning system which may apply a cleanser and a rinsing agent to the surface of the band at some point remote from the casting mold. Where the cleanser or rinsing agent used is water or similar to water, it must also be thoroughly removed from the band before the band reaches the melt or explosion may result.

An air wipe such as one similar to that disclosed in U.S. Pat. No. 3,722,077 may be used to dry the casting band. An air wipe forces the water off of the band by directing air under pneumatic pressure against the band. Where pneumatic pressure is decreased or lost, however, the water is not removed from the band and the probability of explosion increases significantly. It is for this reason that the fail safe air wipe was invented.

DISCLOSURE OF INVENTION

The present invention eliminates the danger of explosion associated with casting band cleaning systems of continuous casting systems by providing means for ensuring complete removal of cleansers and rinsing agents such as water from the casting band before the band receives the molten material. This invention is a fail safe air wipe comprising pneumatic wiping means and mechanical wiping means activated by malfunction of the pneumatic wiping means.

Thus a major object of the present invention is to provide apparatus to ensure that cleanser and rinsing agent is continuously removed from the casting band of a band type continuous casting machine to prevent explosion.

BRIEF DESCRIPTION OF THE DRAWINGS

While the specification concludes with claims particularly pointing out and distinctly claiming the subject matter which is regarded as the invention, it is believed that the invention, objects, features and advantages thereof will be better understood from the following description taken in connection with the accompanied drawings in which like parts are given like identification numerals and wherein:

BEST MODE FOR CARRYING OUT THE INVENTION

Figure 1:
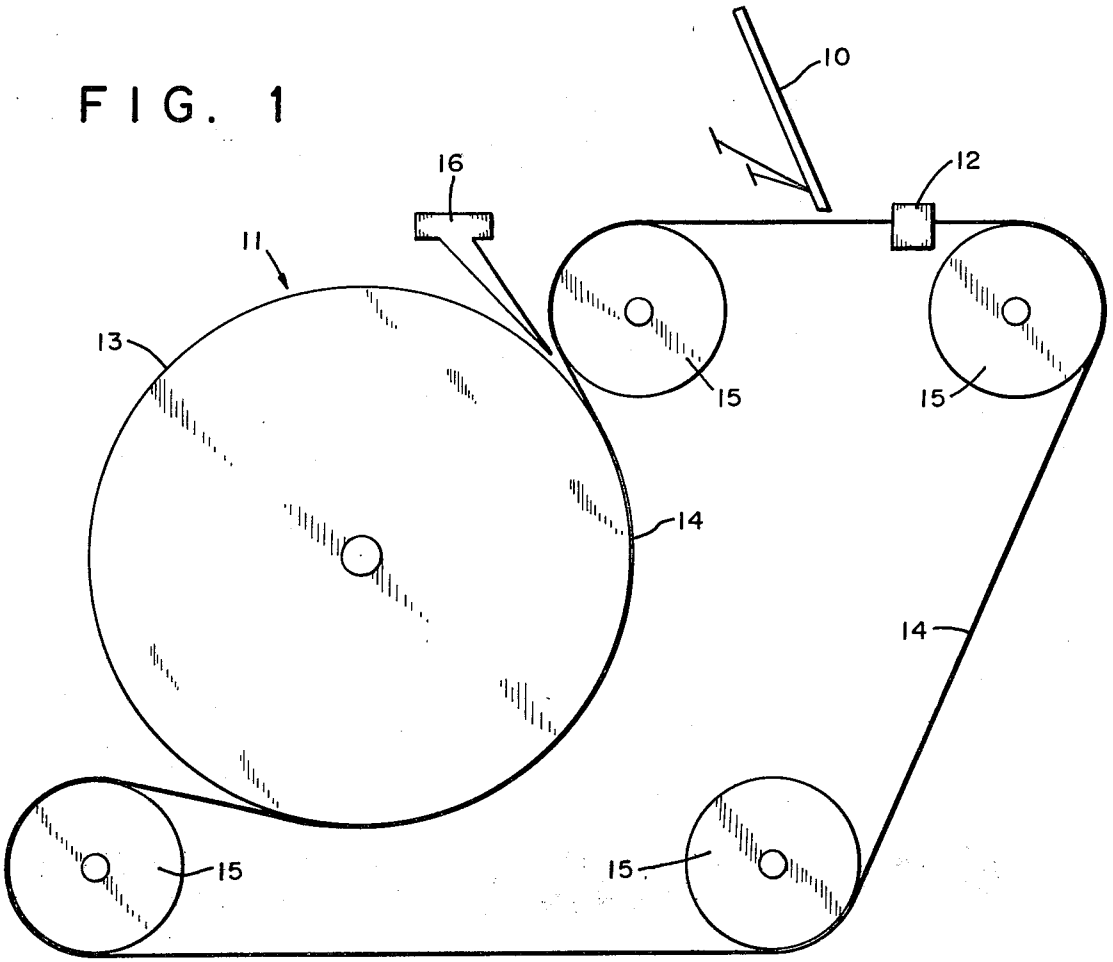
FIG. 1 is a diagram of the present invention in cooperation with a casting machine and a band cleaning means.

As FIG. 1 illustrates, the preferred embodiment of the fail safe air wipe 10 cooperates with a band type casting machine 11 and casting band cleaning means 12. The casting machine 11 comprises a casting wheel 13 a casting band 14 and a plurality of rollers 15 which guide the casting band 14 along a path adjacent to the casting wheel 13 for forming a continuous mold therewith into which pouring means 16 pours melt, then remote from the casting wheel 13 for cleaning by cleaning means 12 and then return to the casting wheel 13. Cleaning means 12 may apply cleanser and rinsing agent to the casting band 14, either of which may be water. Since water can not be permitted to enter the melt, the present invention is positioned between the cleaning means 12 and the casting wheel 13. While a conventional wheel and band type casting machine 11 is shown, the invention anticipates use of other band type casting machines such as dual or multiple band casting machines. This invention is suited for start up procedure as well as continuous operation.

Figure 2:
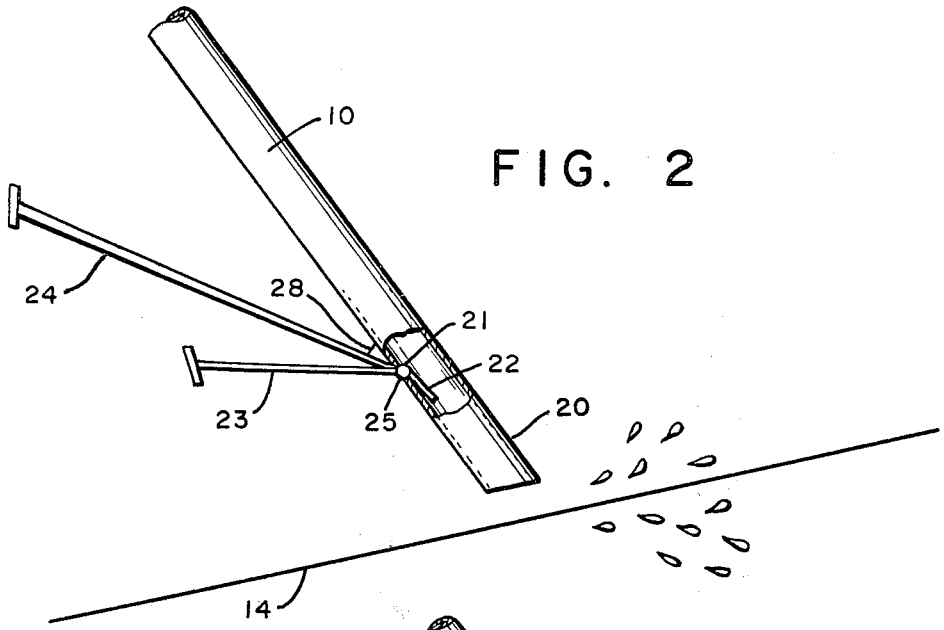
FIG. 2 is a view of the present invention with pneumatic operability.

Referring to FIG. 2 it can be seen that the fail safe air wipe 10 comprises a pneumatic air wipe 20 supplied by air under pressure from pneumatic supply means (not shown) and mechanical wiping means 21 downstream of and in tandem relationship with the air wipe 20. The mechanical wiping means 21 is activated by malfunction of the pneumatic air wipe 20. The mechanical wiping means 21 comprises an activator 22, a first wiping member 23, a second wiping member 24, and means for interconnecting the three 25. While pneumatic pressure remains at proper level to force water completely off of the band 14, there is sufficient pressure to retain the activator 22 in place generally parallel with the longitudinal axis of the air wipe 20 which keeps the first wiping member 23 and second wiping member 24 up and away from the band 14.

Figure 3:
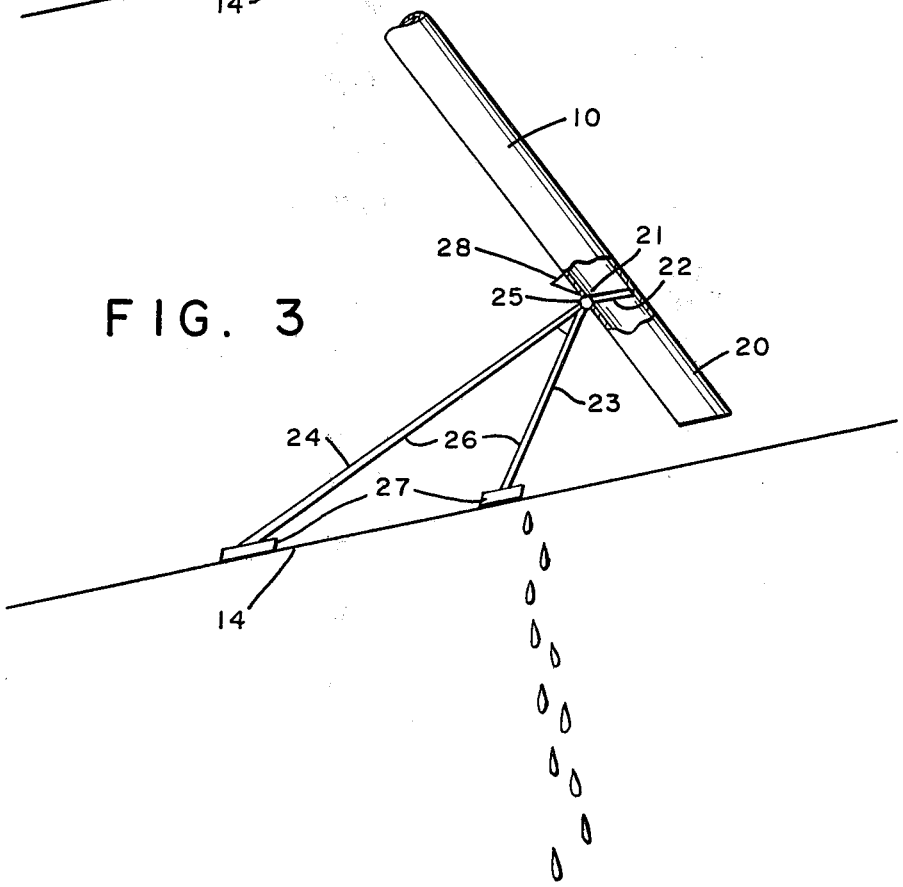
FIG. 3 is a view of the present invention in mechanical wiping mode.

When pneumatic pressure decreases to below a level sufficient to force water off of the band 14 the pressure is also not sufficient to retain the activator 22 in parallel alignment. Therefore as FIG. 3 illustrates, the unbalanced normal force of the members 23 and 24 forces the activator 22 to rotate on interconnection means 25 and move up into near sealing relationship with the inner surfaces of the air wipe 20 as members 23 and 24 move down to contact the advancing band 14.

Since a portion of the band 14 bearing water has passed the point for pneumatic removal of water during the time required for the first mechanical wiping member 23 to come into contact with the band 14, the first mechanical wiping member 23 contacts the band 14 downstream of the air wipe 20 a distance sufficient to overtake and remove the water thereon. Each mechanical wiping member 23 and 24 comprises an arm 26 and a wiper blade 27. The arms 26 are aligned generally parallel with the longitudinal axis of the casting band 14 and the wiper blades 27 are formed of resilient elastomer material and are angularly disposed at about 45° from the longitudinal axis of the band 14 to promote quick removal of water by an irresistible path.

The second mechanical wiping member 24 has several functions. First, it provides backup for the first wiping member 23 to remove any water which may have passed both the air wipe 20 and the first wiping member 23 during the time required for the first member 23 to reach the wiping position by being down stream of and in tandem relationship with the first wiping member 23 during the time required for the first member 23 to reach wiping position. Second, the second wiping member 24 provides continuous assurance that all the water will be removed by continuously supplementing wiping by the first member 23. A third function is discussed below.

Figure 6:
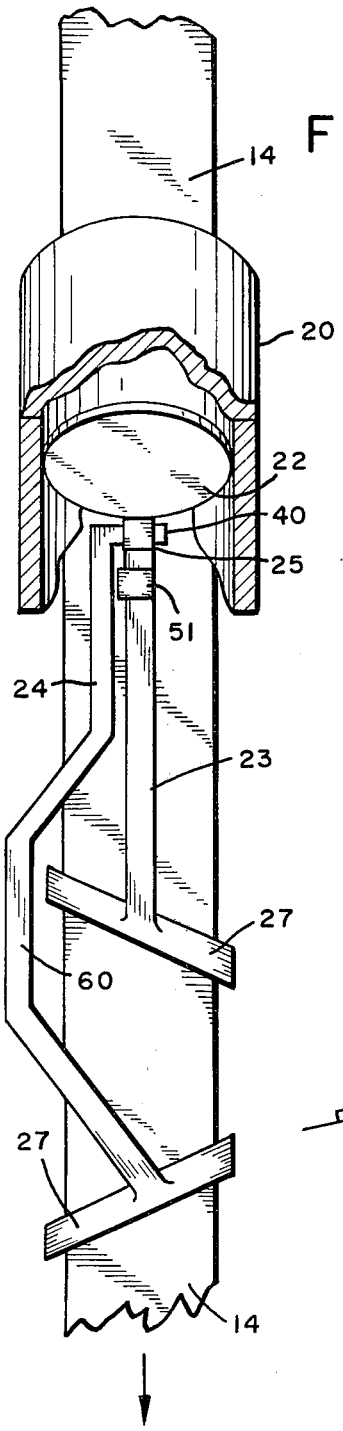
FIG. 6 is a partial cross sectional top view of the present invention
Figure 4:
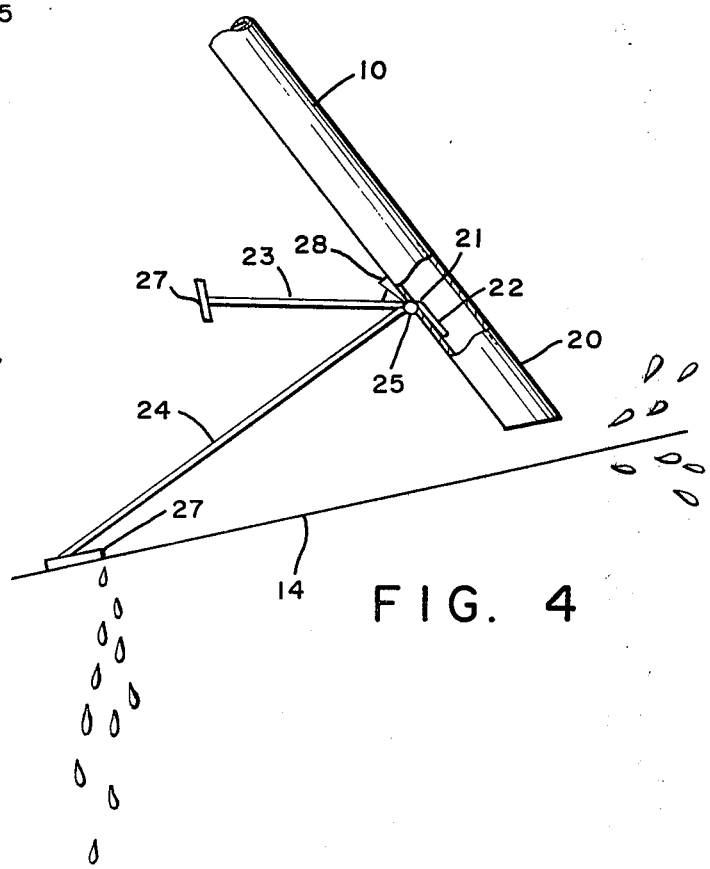
FIG. 4 is a view of the present invention in transition from mechanical to pneumatic wiping mode.
Figure 5:
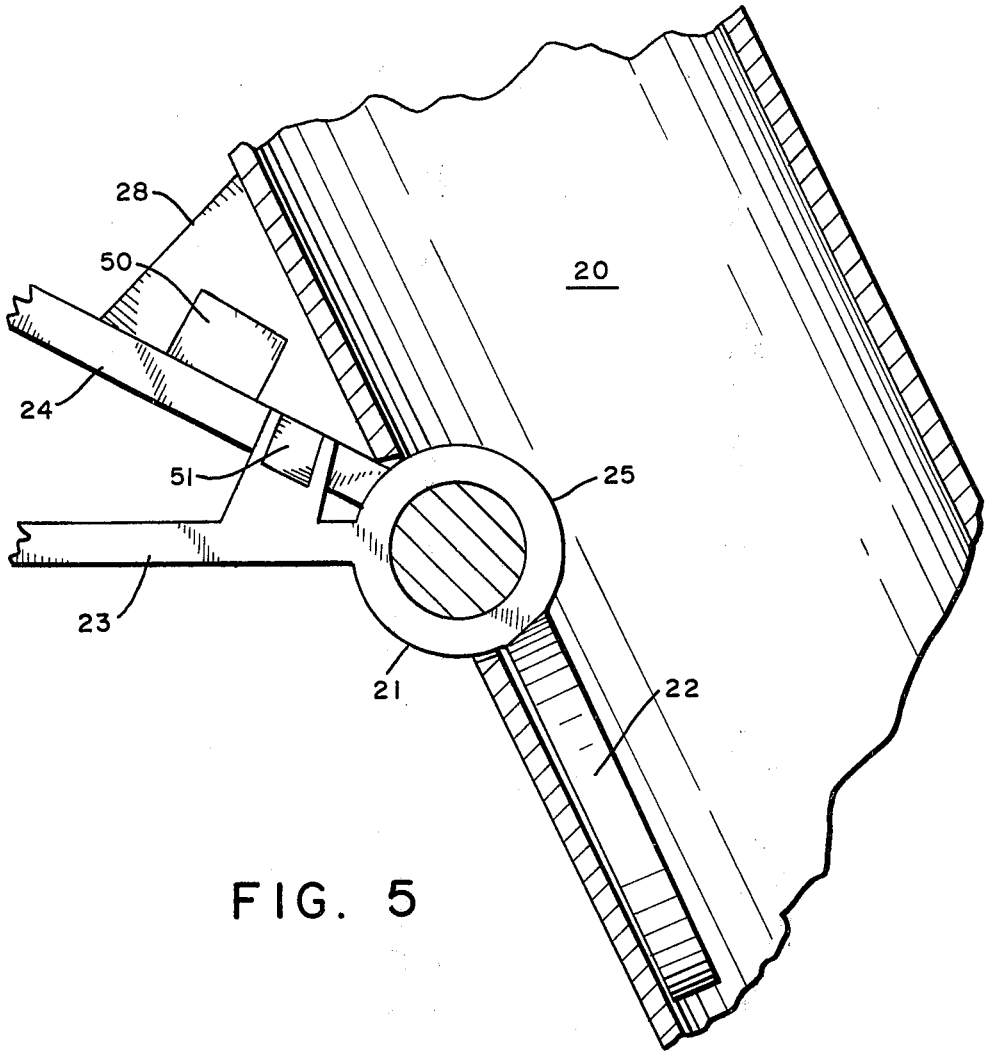
FIG. 5 is a detailed view of activation means of the present invention.

FIG. 4 shows transition from mechanical wiping back to pneumatic wiping. As pneumatic pressure increases above the level required to remove all water from the band 14 pneumatically, the pressure is also sufficient to force the activator 22 down to its original position generally parallel with the longitudinal axis of the air wipe 20. As FIG. 6 illustrates, the activator 22 is of a configuration similar to the cross sectional inner pneumatic stream area of the air wipe 20 to provide back pressure for returning the activator to its original position. The activator 22 and the first wiping member 23 are rigidly secured to the interconnection means 25 as shown in FIG. 5 to form a predetermined angularity which places the wiper blade 27 of the first member 23 on the surface of the casting band 14 while the activator 22 is substantially perpendicular to the longitudinal axis of the air wipe 20. As the activator 22 moves under pneumatic pressure toward a position generally parallel with the longitudinal axis of the air wipe 20, the first member 23 rigidly connected thereto moves up and away from the casting band 14. The second wiping member 24 as shown in FIG. 5 is not rigidly connected to the activator 22. Instead, the second wiping member 24 is rotatably connected to the interconnection means 25 such that when pneumatic pressure forces the activator 22 downward and the first wiping member 23 upward, the second wiping member 24 independently remains in contact with the casting band 14 to achieve a third function of the second wiping member 24 which is to remove water from the band 14 area which was between the air wipe 20 and the first wiping member 23 when pneumatic operability returned and as a result was not removed by either air wipe 20 or first wiping member 23, and to remove water which had condensed within the pneumatic system and was expelled onto the band 14 when pneumatic operability first returned. Thus as FIG. 4 illustrates, when sufficient pneumatic pressure returns, both the air wipe 20 and the second wiping means 24 remove water from the band 14. When it is certain that the air wipe 20 is functioning properly, and no water had passed the air wipe 20 without being removed, the second wiping member 24 can be manually or otherwise individually deactivated and lifted up to its original position as shown in FIG. 2 where it will be held ready for the next pneumatic malfunction by home position maintenance means 50 and 51 of FIG. 5.

Referring to FIG. 5 which shows the interaction of parts in more detail, it can be seen that home position maintenance means 50 and 51 cooperate to hold member 24 in position against stop 28 while member 23 is stopped by contact of activator 22 against the inner wall of the air wipe 20. While many home position mechanisms such as rachets, catches springs and others are contemplated, it is preferred that such be comprised of a magnet 50 mounted within stop 28 and a magnet 51 mounted atop member 23. Neither magnet 50 nor magnet 51 is of sufficient magnetic strength to hold member 24 in home position, but together they cooperate to do so while member 23 is in home position as shown such that while in home position, member 24 is dependent on member 23 for position maintenance. As pneumatic pressure through air wipe 20 decreases to below a level sufficient to pneumatically remove water from the band 14, the weight of member 23 causes member 23 to rotate downward thus removing magnetic support from member 24 and allowing member 24 to rotate downward as previously explained. When pneumatic pressure returns to a minimum acceptable level, member 23 rotates upward to the position shown while leaving independent member 24 in mechanical wiping mode as discussed above. When member 24 is manually returned to home position, magnets 50 and 51 again cooperate to hold member 24 is such position depending on member 23 for support.

Referring again to FIG. 2 where the first wiping member 23 and the second wiping member 24 are in original position, it can be seen that upward rotation of the first wiping member 23 is limited by downward rotation of the activator 22 which stops against the inside surface of the air wipe 20, and that upward rotation of the second wiping member 24 is limited by stop 28. The angularity between member 23 and member 24 while in original position is substantially identical to the angularity in wiping position as shown in FIG. 3 where band 14 is in its predetermined position. This angularity causes the first member 23 and the second member 24 to reach the surface of the casting band 14 substantially simultaneously upon activation. As the casting band 14 advances toward the casting wheel 13 it may fluctuate upward or downward. To maintain constant wiping, the mechanical wiping means 21 must respond to such fluctuations. To accomplish this, the first mechanical wiping member 23 floats on the surface of the casting band 14 by rotating along interconnection means 25. The outer dimension of the activator 22 is slightly smaller than the inner dimension of the air wipe 20 to allow such rotation. The second mechanical wiping member 24 floats on the surface of the casting band 14 independent of the first member 23.

Viewed from above in FIG. 6 having portions of the air wipe 20 cut away and some parts missing for better illustration, it can be seen that independent upward rotatability of the second wiping member 24 requires a dog leg 60 traversing the arcuate path of the wiper blade 27 of the first wiping member 23 to avoid rotational interference. Further, while blades 27 are shown with reciprocal angularity, the invention anticipates substantially parallel alignment thereof.

While this invention has been described in detail with particular reference to a preferred embodiment thereof, it will be understood that variations and modifications can be effective within the spirit and scope of the invention as described herein before and as defined in the appended claims.

INDUSTRIAL APPLICABILITY

This invention is capable of exploitation in the metal casting industry and is particularly useful in a system for cleaning the casting band of a continuous casting machine.

I claim:

1. A fail safe air wipe for use in a casting band cleaning system of a band type continuous casting system for thoroughly removing cleanser and rinsing agent from the band comprising:

(a) pneumatic wiping means situated near the casting band and between the position where cleanser and rinsing agent is applied and the position where molten metal is poured into a continuously formed mold; and (b) mechanical wiping means connected to said pneumatic wiping means downstream of and in tandem relationship with said pneumatic wiping means;

an activator means is provided for activating said mechanical wiping means by insufficient pressure of said pneumatic wiping means.

2. The apparatus of claim 1 wherein said mechanical wiping means further comprises:

(a) an activator positioned within said pneumatic wiping means and having a shape which fits a cross sectional area of the inside pneumatic stream area of said pneumatic wiping means while pneumatic pressure is insufficient for thoroughly pneumatically removing all cleanser and rinsing agent and adapted to be forced into an alignment parallel with the longitudinal axis of said pneumatic wiping means when pneumatic pressure is sufficient for thorough cleanser and rinsing agent removal;

(b) a first mechanical wiping member rigidly secured to said activator by interconnection means in a predetermined angularity such that while said activator is in sealing relationship with said pneumatic wiping means, the first mechanical wiping member is in wiping contact with said casting band and such that while said activator is held in substantially parallel relationship with the longitudinal axis of said pneumatic wiping means by the pneumatic pressure, the first mechanical wiping member is positioned above and away from the casting band;

(c) a second mechanical wiping member independently rotatably secured to said activator and said first mechanical wiping member and extending past the wiping portion of said first mechanical wiping member; and (d) a first position maintenance means connected to said pneumatic wiping means and a second position maintenance means connected to said first mechanical wiping member for assuring retention in the deactivated position of said second mechanical wiping member dependent on retention of said first mechanical wiping member in the deactivated position while ensuring independent rotation of said second mechanical wiping means while at least one of said members is not in the deactivated position.

3. The apparatus of claim 2 wherein, each of said wiping members further comprises a wiping blade formed of resilient elastomer material and angularly disposed at about 45° from the longitudinal axis of said casting band to promote quick removal of cleanser and rinsing agent.

4. The apparatus of claim 3 wherein said first mechanical wiping member further comprises means for contacting the surface of said casting band when activated at a position downstream of the area where said pneumatic wiping means is directed to pneumatically remove cleanser and rinsing agent in order to overtake and remove the cleanser and rinsing agent which remained on the band and passed the pneumatic wiping means during the time required for said first mechanical wiping means to move into wiping position.

5. The apparatus of claim 3 wherein said second mechanical wiping member further comprises means for contacting the surface of said casting band when activated at a position downstream of a position where said first mechanical wiping means contacts said casting band and in tandem relationship therewith to remove cleanser and rinsing agent which passed both said pneumatic wiping means and said first mechanical wiping member during the time required for the first mechanical wiping member to reach wiping position by moving into wiping position at substantially the same time.

6. The apparatus of claim 5 wherein said second mechanical wiping member further comprises means for continuously supplementing wiping of said first mechanical wiping member.

7. The apparatus of claim 4 wherein said first mechanical wiping member further comprises means for automatically ceasing wiping when pressure within said pneumatic wiping means increases to operable level by being rigidly attached to said activator which rotates in a deactivating direction under said pressure.

8. The apparatus of claim 5 wherein said second mechanical wiping member further comprises means for continuing wiping independent of the action of said first mechanical wiping member to assure removal of cleanser and rinsing agent which has passed said pneumatic wiping means before reactivation thereof but has not passed said first mechanical wiping member before deactivation thereof and to assure removal of condensation expelled from said pneumatic wiping means.

9. The apparatus of claim 8 wherein said second mechanical wiping member further comprises means for independent deactivation thereof after it is ascertained that said pneumatic wiping means is functioning properly and no cleanser, rinsing agent or condensation has passed said pneumatic wiping means without being removed.

10. The apparatus of claim 9 wherein said second mechanical wiping member further comprises a dog leg portion traversing the arcuate path of the wiper blade of said first mechanical wiping member to avoid rotational interference therewith.

11. The apparatus of claim 4 wherein said first wiping member further comprises means for floating said blade on the surface of said casting band by rotating along said interconnection means to assure complete cleanser and rinsing agent removal during casting band fluctuations.

12. The apparatus of claim 5 wherein said second wiping means further comprises means for floating said blade on the surface of said casting band by rotating along said interconnection means independent of said first mechanical wiping member to assure complete cleanser, rinsing agent and condensation removal during casting band fluctuations.

13. The apparatus of claim 2 wherein said first and second position maintenance means comprises at least two magnets neither having sufficient magnetic strength alone to hold said second member in deactivated position such that said second member can be retained in deactivated position only when both said first member and said second member are in deactivated position.

* * * * *